US009114962B2

(12) United States Patent
Parrish

(10) Patent No.: US 9,114,962 B2
(45) Date of Patent: Aug. 25, 2015

(54) COMPONENT HANDLING SYSTEM FOR ASSEMBLING VEHICLES AND METHODS OF ASSEMBLING VEHICLES

(75) Inventor: Grover Parrish, Glencoe, AL (US)

(73) Assignee: Honda Motor Co., Ltd., Minato-Ku (JP)

( * ) Notice: Subject to any disclaimer, the term of this patent is extended or adjusted under 35 U.S.C. 154(b) by 680 days.

(21) Appl. No.: 13/314,857

(22) Filed: Dec. 8, 2011

(65) Prior Publication Data

US 2013/0145602 A1 Jun. 13, 2013

(51) Int. Cl.
*B66D 3/18* (2006.01)
*B66C 17/06* (2006.01)

(52) U.S. Cl.
CPC . *B66D 3/18* (2013.01); *B66C 17/06* (2013.01); *Y10T 29/49622* (2015.01); *Y10T 29/49902* (2015.01)

(58) Field of Classification Search
CPC .... B62D 65/02; B62D 65/022; B62D 65/024; B62D 65/028; B62D 65/06; B66C 1/10; B66C 1/62
USPC ..... 29/897.2, 429, 464, 468, 281.5; 212/73, 212/74, 324, 326, 225, 228, 250; 414/751.1, 752.1, 728
See application file for complete search history.

(56) References Cited

U.S. PATENT DOCUMENTS

| | | | | | |
|---|---|---|---|---|---|
| 145,234 | A | * | 12/1873 | Pennock | 212/225 |
| 453,006 | A | * | 5/1891 | James | 104/162 |
| 477,621 | A | * | 6/1892 | Bulmer | 212/228 |
| 489,634 | A | * | 1/1893 | Hemphill | 212/71 |
| 489,635 | A | * | 1/1893 | Hemphill | 212/71 |
| 2,535,961 | A | * | 12/1950 | Schutt | 212/225 |
| 2,877,905 | A | * | 3/1959 | Wiley | 212/225 |
| 3,572,513 | A | * | 3/1971 | Tantlinger et al. | 212/180 |
| 3,951,400 | A | * | 4/1976 | Blessing et al. | 271/85 |
| 4,589,184 | A | | 5/1986 | Asano et al. | |
| 4,609,093 | A | | 9/1986 | Taketani et al. | |
| 4,627,158 | A | | 12/1986 | Mitoh | |
| 4,724,944 | A | | 2/1988 | Koshigai et al. | |
| 4,797,059 | A | * | 1/1989 | Karg et al. | 414/590 |
| 4,875,280 | A | | 10/1989 | Fujioka et al. | |
| 4,930,213 | A | | 6/1990 | Hayakawa et al. | |
| 5,181,307 | A | * | 1/1993 | Kitahama et al. | 29/434 |
| 5,319,840 | A | | 6/1994 | Yamamoto et al. | |

(Continued)

FOREIGN PATENT DOCUMENTS

| | | | |
|---|---|---|---|
| FR | 2933366 | * | 7/2008 |
| JP | 6317013 | | 11/1999 |

OTHER PUBLICATIONS

English Machine Translation of FR2933366.*

(Continued)

*Primary Examiner* — Christopher M Koehler
(74) *Attorney, Agent, or Firm* — Armstrong Teasdale LLP

(57) ABSTRACT

A component handling system for use in assembling a vehicle is described herein. The vehicle includes a vehicle frame and at least one component adapted to be coupled to the vehicle frame. The component handling system includes a lifting assembly that is slideably coupled to a support frame. The lifting assembly is configured to receive a component and to support the component from the support frame. A positioning assembly is coupled to the lifting assembly, and is configured to move the lifting assembly along the support frame to bias the component towards the vehicle frame.

8 Claims, 5 Drawing Sheets

(56) References Cited

U.S. PATENT DOCUMENTS

| | | | | |
|---|---|---|---|---|
| 5,372,469 | A * | 12/1994 | Kobayashi | 414/543 |
| 5,400,943 | A * | 3/1995 | Rossi | 228/6.1 |
| 5,404,641 | A * | 4/1995 | Bratten et al. | 29/897.2 |
| 5,406,697 | A * | 4/1995 | Busisi | 29/721 |
| 5,428,880 | A | 7/1995 | Tomioka et al. | |
| 5,477,603 | A * | 12/1995 | Kemichick | 29/468 |
| 5,494,117 | A * | 2/1996 | Aldridge | 173/28 |
| 5,630,695 | A * | 5/1997 | McDonnell | 414/751.1 |
| 6,202,296 | B1 | 3/2001 | Tatsuda et al. | |
| 6,311,382 | B1 * | 11/2001 | Jack | 29/464 |
| 6,604,279 | B2 | 8/2003 | Kurtz | |
| 6,643,905 | B2 * | 11/2003 | Rhoads et al. | 29/407.09 |
| 6,708,393 | B1 * | 3/2004 | Roy et al. | 29/714 |
| 6,895,647 | B2 * | 5/2005 | Matsumoto et al. | 29/281.4 |
| 6,910,254 | B2 * | 6/2005 | Aoki et al. | 29/464 |
| 7,008,166 | B1 | 3/2006 | Grimes | |
| 7,039,995 | B2 * | 5/2006 | Thompson | 29/281.5 |
| 7,048,491 | B2 | 5/2006 | Windbergs | |
| 7,143,494 | B2 * | 12/2006 | Savoy | 29/407.1 |
| 7,310,865 | B2 * | 12/2007 | Cole et al. | 29/281.5 |
| 7,498,541 | B2 | 3/2009 | Inoue et al. | |
| 7,627,945 | B2 | 12/2009 | Lee | |
| 8,108,978 | B2 * | 2/2012 | Van Zile, III | 29/281.5 |
| 8,534,630 | B2 * | 9/2013 | Phillips | 248/327 |
| 2002/0138962 | A1 * | 10/2002 | Martin et al. | 29/430 |
| 2007/0079503 | A1 * | 4/2007 | Lee | 29/787 |
| 2007/0204449 | A1 | 9/2007 | DuVernay | |
| 2009/0230072 | A1 * | 9/2009 | Wierzba et al. | 212/324 |
| 2010/0185321 | A1 * | 7/2010 | Odashima | 700/230 |
| 2010/0319193 | A1 * | 12/2010 | Ushio et al. | 29/822 |
| 2011/0127230 | A1 * | 6/2011 | Laliberte et al. | 212/324 |
| 2013/0146732 | A1 * | 6/2013 | Phillips | 248/328 |

OTHER PUBLICATIONS

Greg, Paula, Cobots for the Assembly Line, The American Society of Mechanical Engineers, 1997.

R.P. Gatta, Inc., products available at http://www.rpgatta.com/products.htm (last viewed Dec. 8, 2011).

* cited by examiner

COMPONENT HANDLING SYSTEM FOR ASSEMBLING VEHICLES AND METHODS OF ASSEMBLING VEHICLES

BACKGROUND

The field of the disclosure relates generally to automobiles, and more specifically, to a component handling system for assembling vehicles and methods of assembling vehicles.

At least some known vehicles include a vehicle frame, and a plurality of components that are coupled to the vehicle frame to form the vehicle. Known vehicle components are assembled using a lift assist assembly to enable a human operator to lift a component, and move the component towards the vehicle frame. At least some known lift assemblies include pneumatic balancers that use pressurized air to counterbalance the weight of the component to enable the lift assist assembly to support the component weight in a vertical direction. However, the operator is required to move the component from a supply area towards the vehicle frame.

During assembly of at least some known vehicles, at least two human operators are required to assemble a component to a vehicle frame. In general, a first operator operates the lift assist assembly to support the component, manually moves the component towards the vehicle frame, and presses the component against the vehicle frame. A second operator then couples the component to the vehicle with the first operator holding the component against the frame. Because known lift assist assemblies require two operators to assemble a component to a vehicle frame the cost of assembling a vehicle is increased.

BRIEF DESCRIPTION

In one embodiment, a component handling system for use in assembling a vehicle is provided. The vehicle includes a vehicle frame and at least one component adapted to be coupled to the vehicle frame. The component handling system includes a lifting assembly that is slideably coupled to a support frame. The lifting assembly is configured to receive a component and to support the component from the support frame. A positioning assembly is coupled to the lifting assembly, and is configured to move the lifting assembly along the support frame to bias the component towards the vehicle frame.

In another embodiment, a positioning assembly for use in assembling a vehicle is provided. The vehicle includes a vehicle frame and at least one component adapted to be coupled to the vehicle frame to form the vehicle. The positioning assembly includes a positioning device that is coupled to a lifting assembly. The lifting assembly is coupled to a support frame for supporting the component from the support frame. The positioning device is configured to move the lifting assembly towards the vehicle frame to position the component with respect to the vehicle frame.

In yet another embodiment, a method of assembling a vehicle is provided. The vehicle includes a vehicle frame and at least one component adapted to be coupled to the vehicle frame. The method includes releasably coupling a first component to a lifting assembly, wherein the lifting assembly is slideably coupled to a support frame to support the first component from the support frame. The method also includes, operating a positioning assembly to move the lifting assembly towards the vehicle frame such that the component is biased against the vehicle frame, and coupling the component to the vehicle frame.

The features, functions, and advantages that have been discussed can be achieved independently in various embodiments or may be combined in yet other embodiments, further details of which can be seen with reference to the following description and drawings.

DETAILED DESCRIPTION

The component handling system described herein overcomes at least some of the limitations of known lift assist assemblies by providing a component handling system that moves a component towards a vehicle frame to enable one operator to couple the component to the vehicle frame. More specifically, the component handling system described herein includes a lifting assembly that is configured to support the component, and a positioning assembly that is configured to move the lifting assembly to position the component with respect to the vehicle frame. In addition, the positioning assembly is configured to move the lifting assembly such that the lifting assembly biases the component against the vehicle frame to enable the operator to couple the component to the vehicle frame. By providing a component handling assembly that moves the component towards the vehicle frame, and supports the component adjacent the vehicle frame, the component handling system enables one operator to move a component from a supply area to a vehicle frame, and couple the component to the vehicle frame to form the vehicle. As such, the cost of assembling a vehicle is reduced over known assembling methods.

As used herein, an element or step recited in the singular and proceeded with the word "a" or "an" should be understood as not excluding plural elements or steps unless such exclusion is explicitly recited. Furthermore, references to "one embodiment" of the present invention or the "exemplary embodiment" are not intended to be interpreted as excluding the existence of additional embodiments that also incorporate the recited features.

Figure 1:
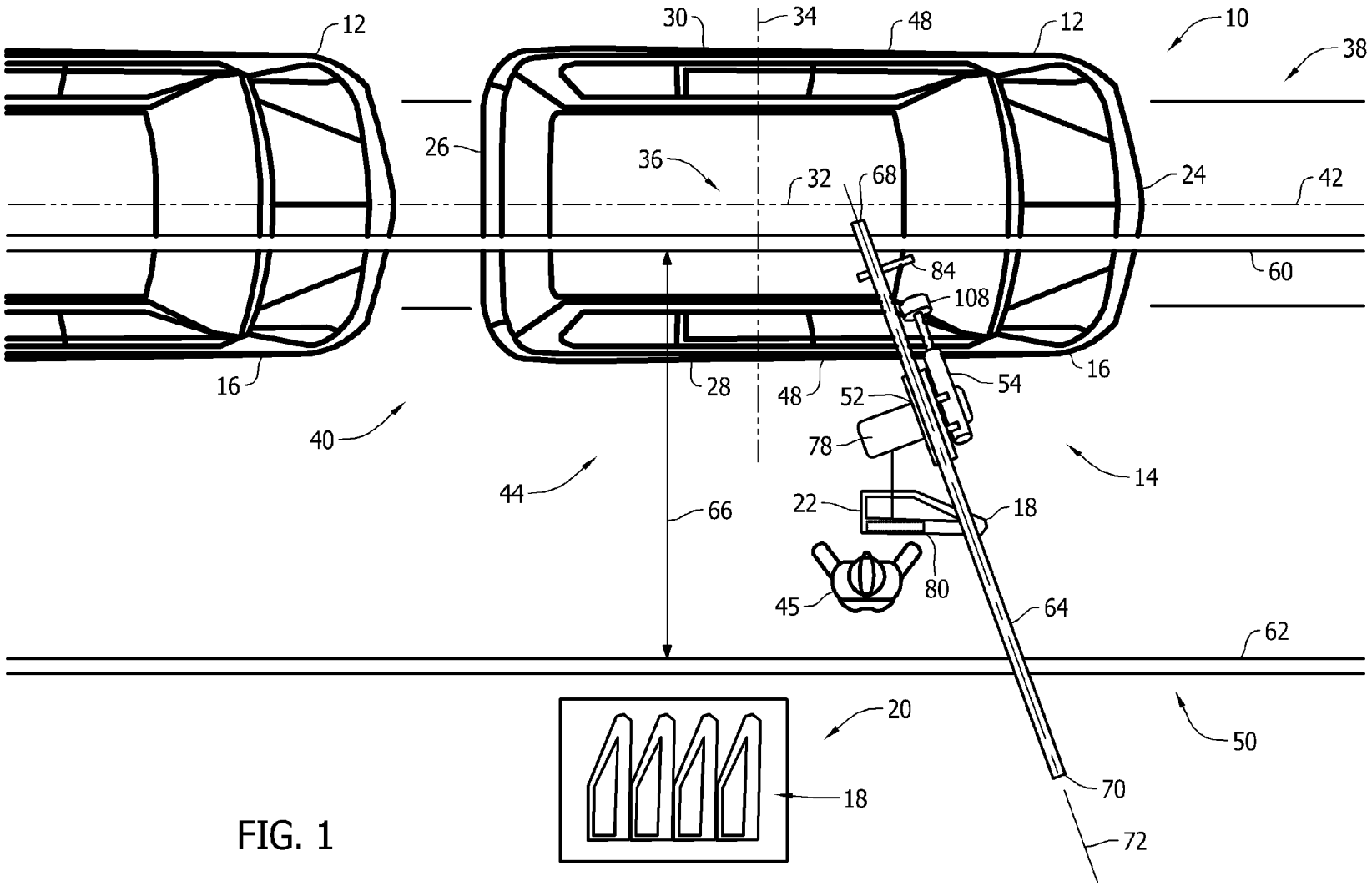
FIG. 1 is a schematic top view of one embodiment of a manufacturing process for manufacturing a vehicle including an exemplary component handling system.
Figure 2:
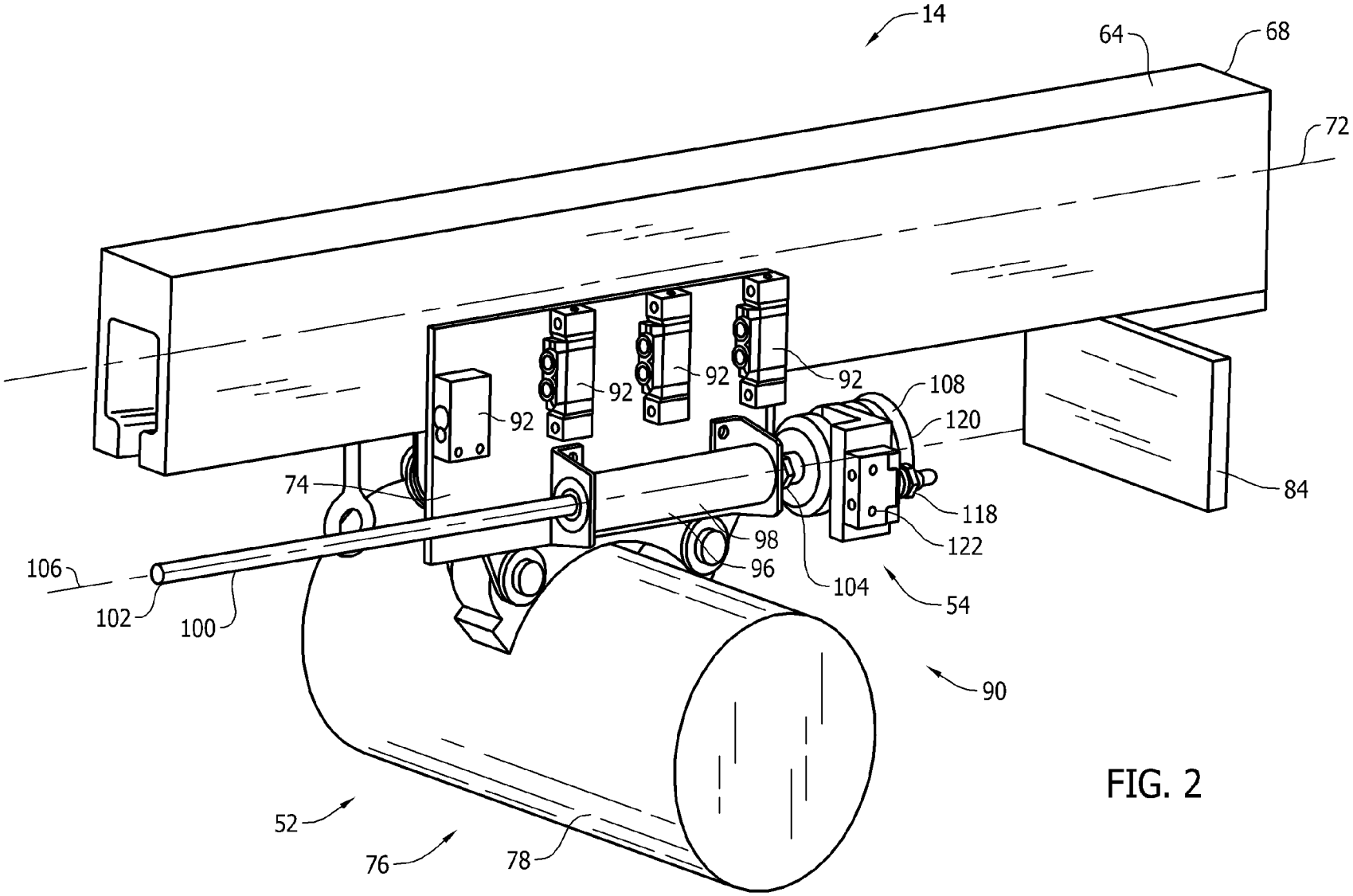
FIG. 2 is a partial perspective view of the component handling system shown in FIG. 1.
Figure 3:
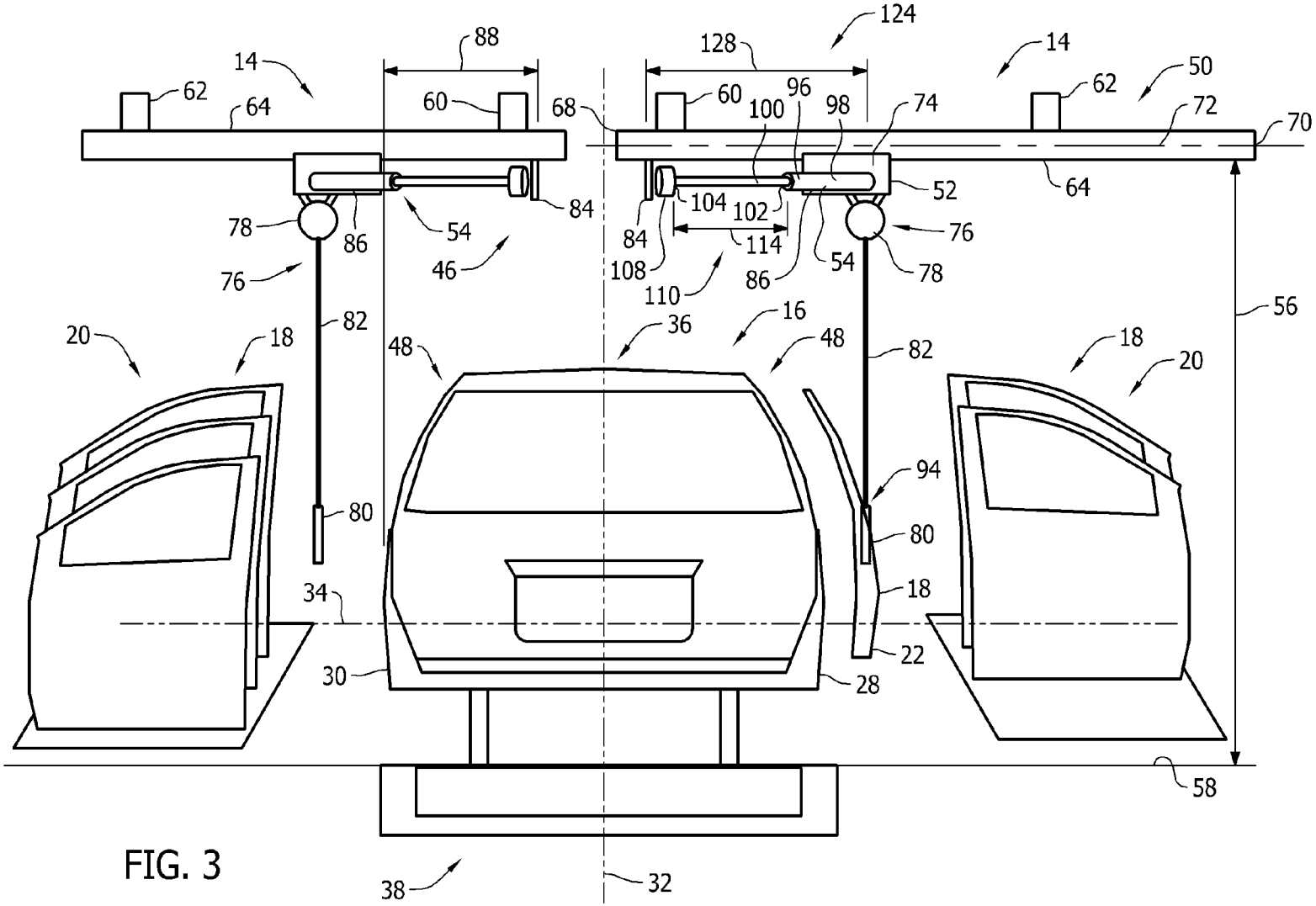
FIG. 3 is a schematic side view of the component handling system shown in FIG. 1 in a first position.
Figure 4:
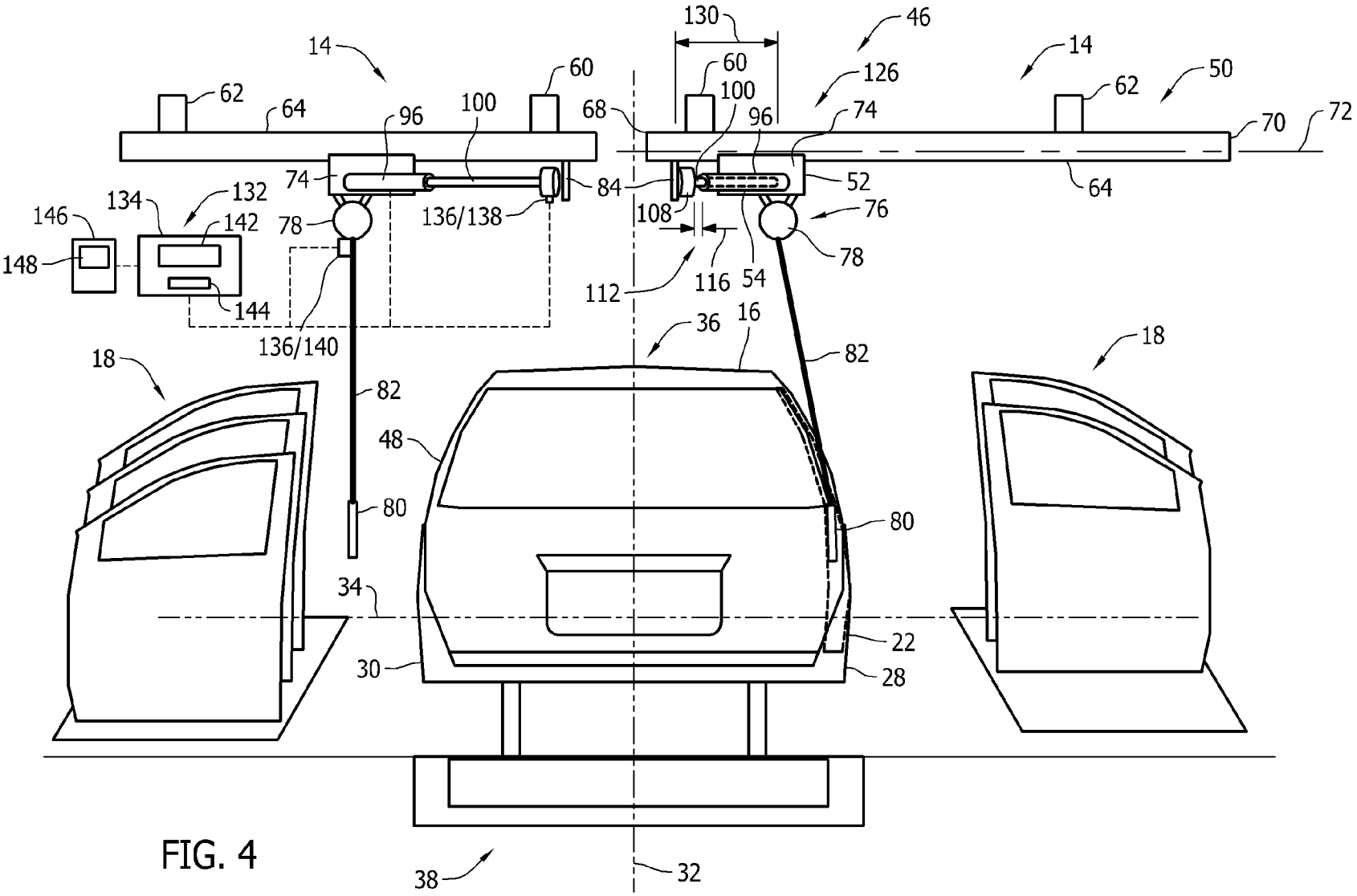
FIG. 4 is a schematic side view of the component handling system shown in FIG. 1 in a second position.

FIG. 1 is a schematic top view of one embodiment of a manufacturing process 10 that may be used for manufacturing a vehicle 12. FIG. 2 is a partial perspective view of an exemplary component handling system 14 that may be used with process 10. FIG. 3 is a schematic side view of component handling system 14 in a first position. FIG. 4 is a schematic side view of component handling system 14 in a second position. In the exemplary embodiment, vehicle 12 includes a vehicle frame 16 and a plurality of components 18 that are adapted to be coupled to vehicle frame 16 to form vehicle 12. Vehicle frame 16 may include, but is not limited to only including, a frame, a chassis, a vehicle body, and/or any support frame that enables component handling system 14 to function as described herein. Component handling system 14 is configured to receive a component 18 from a supply area 20, and move component 18 from supply area 20 towards vehicle frame 16 to facilitate coupling component 18 to vehicle frame 16 to form vehicle 12. In one embodiment, component 18 is a vehicle door 22. In another embodiment, component 18 may be an engine, a transmission, a seat, a suspension system, and/or any vehicle part that is adapted to be coupled to vehicle frame 16 to form vehicle 12. Vehicle frame 16 includes a forward portion 24, a rear portion 26, a first side panel 28, and a second side panel 30. Side panels 28 and 30 each extend between forward portion 24 and rear portion 26 along a vehicle longitudinal axis 32 that is defined between forward portion 24 and rear portion 26. First side panel 28 is axially spaced from second side panel 30 along a transverse axis 34 that is substantially perpendicular to vehicle longitudinal axis 32 such that a middle portion 36 of vehicle frame 16 is defined between first side panel 28 and second side panel 30.

In the exemplary embodiment, a conveyance system 38 continuously conveys a plurality of vehicle frames 16 toward component handling system 14 in an assembly line 40 that is oriented along a centerline axis 42. Each vehicle frame 16 is conveyed to an assembly area 44 that is adjacent component handling system 14 to enable a user 45 to operate component handling system 14 to facilitate coupling component 18 to vehicle frame 16 to assemble vehicle 12. In one embodiment, process 10 uses a pair 46 of component handling systems 14 (shown in FIG. 2) to enable a user to access each side 48 of vehicle 12.

In the exemplary embodiment, component handling system 14 includes a support frame 50, a lifting assembly 52 that is slideably coupled to support frame 50, and a positioning assembly 54 that is coupled to lifting assembly 52 to move lifting assembly 52 with respect to support frame 50. Support frame 50 is spaced a distance 56 above a supporting surface 58 such that support frame 50 is oriented vertically above vehicle frame 16. Support frame 50 includes a first support member 60, a second support member 62, and a guiderail 64 that extends between first and second members 60 and 62. First support member 60 and second support member 62 are each oriented substantially parallel to vehicle longitudinal axis 32. Second support member 62 is spaced a distance 66 from first support member 60 along vehicle transverse axis 34 such that first support member 60 is positioned nearer to vehicle frame middle portion 36 than second support member 62.

Guiderail 64 is slideably coupled to first support member 60 and second support member 62 such that guiderail 64 is movable with respect to support members 60 and 62 along vehicle longitudinal axis 32. Guiderail 64 includes a first end 68 and a second end 70, and extends between first end 68 and second end 70 along a centerline axis 72. First end 70 is coupled to first support member 60, and second end 70 is coupled to second support member 62. In one embodiment, first and second ends 68 and 70 are each pivotably coupled to support members 60 and 62, respectively, such that an orientation of guiderail 64 with respect to support members 60 and 62 may be adjusted.

In the exemplary embodiment, lifting assembly 52 is slideably coupled to guiderail 64 such that lifting assembly 52 is movable with respect to guiderail 64 along guiderail axis 72. Lifting assembly 52 includes a mounting assembly 74 that is slideably coupled to guiderail 64, and a lift device 76 that is coupled to mounting assembly 74. Lift device 76 includes a lifting apparatus 78, a component support member 80, and one or more lifting legs 82 that extend between lifting apparatus 78 and component support member 80. Component support member 80 is configured to receive component 18 such that component 18 is supported from support frame 50 with lifting assembly 52. Lifting leg 82 is coupled between lifting apparatus 78 and component support member 80 to enable lifting apparatus 78 to support component 18 from support frame 50. In the exemplary embodiment, lifting leg 82 is a cable. Alternatively, lifting leg 82 may be a rod, a rope, a strap, a chain, and/or any suitable device that enables lifting assembly 52 to function as described herein. In the exemplary embodiment, lifting apparatus 78 includes a pneumatic balancer that is configured to support component 18 from guiderail 64 such that component 18 may be moved from supply area 20 towards vehicle frame 16 to facilitate coupling component 18 to vehicle frame 16. Alternatively, lifting apparatus 78 may include a mechanical spring balancer, an electric balancer, a come-along winch assembly, a hydraulic cylinder assembly, a motorized winch assembly, or any suitable device that enables lifting assembly 52 to function as described herein.

In the exemplary embodiment, positioning assembly 54 is coupled to lifting assembly 52 to move lifting assembly 52 towards vehicle frame 16 to position component 18 adjacent to vehicle frame 16 to facilitate coupling component 18 to vehicle frame 16. Positioning assembly 54 includes an attachment member 84 and a positioning device 86 that is adapted to be releasably coupled to attachment member 84. Attachment member 84 is coupled to guiderail first end 68. More specifically as shown in FIG. 3, attachment member 84 is coupled to guiderail first end 68 such that attachment member 84 is spaced a distance 88 from vehicle side 48 measured along vehicle transverse axis 34. Moreover, attachment member 84 is oriented closer to vehicle middle portion 36 than positioning device 86. In one embodiment, attachment member 84 is coupled to guiderail 64 such that attachment member 84 is oriented closer to vehicle middle portion 36 than vehicle side 48. Attachment member 84 extends outwardly from guiderail 64 and is oriented with respect to positioning device 86 to enable positioning device 86 to be selectively coupled to attachment member 84.

In the exemplary embodiment, component handling system 14 includes a pneumatic air system 90 that includes a plurality of air supply lines (not shown) that are coupled to positioning assembly 54 and lifting assembly 52 to channel a supply of pressurized air to each assembly 52 and 54. In addition, pneumatic air system 90 includes a plurality of control valves 92 that are coupled to the air supply lines to enable pressurized air to be selectively channeled to positioning assembly 54 and/or lifting assembly 52 such that component handling system 14 functions as described herein. A control panel 94 including a plurality of push-button control switches (not shown) is coupled in operative communication with each control valve 92 to enable a user to control an operation of component handling system 14. The control panel is mounted to component support member 80 to enable a user to access the control panel when moving component 18 from supply area 20 towards vehicle frame 16.

Positioning device 86 is coupled to lifting assembly 52, and is configured to receive attachment member 84 to move lifting assembly 52 towards attachment member 84. In the exemplary embodiment, positioning device 86 includes a piston assembly 96 that is coupled to lifting assembly 52 for selectively moving lifting assembly 52 along guiderail 64. Piston assembly 96 includes a piston cylinder 98, and a piston 100 that is slideably coupled to piston cylinder 98. In the exemplary embodiment, piston assembly 96 includes a pneumatic piston cylinder including a double acting cylinder. In another embodiment, piston assembly 96 includes a pneumatic piston cylinder including a single acting cylinder including a spring return. Alternatively, piston assembly 96 may include a hydraulic cylinder assembly, a servomechanism, a ball-screw type actuator, and or any suitable actuating device that enables piston assembly 96 to function as described herein.

Piston 100 extends between a first end, i.e. a base end 102 and a second end, i.e. a distal end 104 along a piston centerline axis 106. Base end 102 extends through piston cylinder 98. Distal end 104 extends outwardly from piston cylinder 98 towards attachment member 84. An engagement assembly 108 is coupled to piston distal end 104, and is configured to selectively couple piston 100 to attachment member 84. Piston 100 is movable between a first position, i.e. an extended position 110 (shown in FIG. 3), and a second position, i.e. a retracted position 112 (shown in FIG. 4). In extended position 110, distal end 104 extends outwardly from piston cylinder 98 a first distance 114 measured along piston centerline axis 106. In retracted position 112, distal end 104 extends outwardly from piston cylinder 98 a second distance 116 measured along piston centerline axis that is shorter than first distance 114.

Positioning assembly 54 also includes a position switch 118 that is coupled to positioning device 86 to operate positioning device 86 when engagement assembly 108 contacts attachment member 84. Moreover, position switch 118 is coupled to engagement assembly 108, and is configured to sense a position of engagement assembly 108 with respect to attachment member 84. In addition, position switch 118 is coupled to a pneumatic system control valve 92 for controlling an operation of piston cylinder 98. More specifically, position switch 118 is configured to operate piston cylinder 98 when engagement assembly 108 is coupled to attachment member 84 to move piston 100 from the extended position 110 to the retracted position 112. In one embodiment, position switch 118 includes a mechanical switch (not shown) that is coupled to an air supply line (not shown) of pneumatic air system 90 and is configured to selectively enable a flow of air to be channeled to control valve 92 and/or piston cylinder 98 upon the mechanical switch contacting attachment member 84. Alternatively, position switch 118 may include a reed switch, a reed sensor, an infra-red type sensor, and/or a photo-eye type sensor, and/or any suitable sensing device that enables positioning assembly 54 to operate as described herein.

In the exemplary embodiment, engagement assembly 108 is configured to selectively couple positioning device 86 to attachment member 84 when positioning device 86 is in the extended position 110, and to selectively uncouple positioning device 86 from attachment member 84 when positioning device 86 is in the retracted position 112. More specifically, engagement assembly 108 includes a magnet 120 that is configured to magnetically couple engagement assembly 108 to attachment member 84. In one embodiment, engagement assembly 108 includes an electro-magnetic assembly (not shown) that is configured to be selectively energized such that a user can selectively magnetically couple engagement assembly 108 to attachment member 84. In another embodiment, engagement assembly 108 includes a grasping device (not show) such as, for example, a releasable hook assembly that is configured to receive attachment member 84 to releasably couple attachment member 84 to positioning device 86.

In the exemplary embodiment, engagement assembly 108 includes a release assembly 122 that is coupled to engagement assembly 108 to uncouple engagement assembly 108 from attachment member 84. In an non-limiting example, release assembly 122 is also coupled to pneumatic air system 90, and is configured to selectively channel a jet of air towards attachment member 84 to uncouple engagement assembly 108 from attachment member 84.

In the exemplary embodiment, component handling system 14 is movable between a first position, i.e. a transfer position 124 (shown in FIG. 3) and a second position, i.e. an assembly position 126 (shown in FIG. 4). More specifically, positioning device 86 is configured to move lifting assembly 52 between transfer position 124 and assembly position 126 along guiderail axis 72. In transfer position 124, lifting assembly 52 is oriented a first distance 128 from attachment member 84 measured along guiderail axis 72. In addition, in transfer position 124, positioning device 86 is oriented with respect to attachment member 84 such that engagement assembly 108 is oriented adjacent to attachment member 84 with piston 100 in the extended position 110. In assembly position 126, lifting assembly 52 is oriented a second distance 130 from attachment member 84 that is shorter than first distance 128. Moreover, in assembly position 126, engagement assembly 108 is oriented adjacent to attachment member 84 with piston 100 in the retracted position 112. In addition, in assembly position 126, lifting assembly 52 biases component 18 towards vehicle frame 16 such that component 18 is in contact with vehicle frame 16. More specifically, in assembly position 126, lifting assembly 52 supports component 18 from support frame 50 such that component 18 is biased against vehicle frame 16 to facilitate coupling component 18 to vehicle frame 16.

During operation, a user moves lifting assembly 52 towards supply area 20 along guiderail 64, and couples component support member 80 to a component 18 that is stored in supply area 20. The user operates lifting assembly 52 to lift component 18 upwardly such that component 18 is supported from support frame 50 by lifting assembly 52. The user also moves component 18, lifting assembly 52, and positioning assembly 54 from supply area 20 towards vehicle frame 16. The user operates positioning device 86 to extend piston 100 and engagement assembly 108 from retracted position 112 to extended position 110, and moves component 18 towards vehicle frame 16 to position lifting assembly 52 into transfer position 124 causing engagement assembly 108 to contact attachment member 84. Upon contacting attachment member 84, engagement assembly 108 couples positioning device 86 to attachment member 84, and position switch 118 contacts attachment member 84 to operate piston cylinder 98 to move piston 100 from extended position 110 to retracted position 112. As piston 100 moves to retracted position 112, lifting assembly 52 is moved into assembly position 126 and biases component 18 towards vehicle frame 16 such that component 18 is supported against vehicle frame 16 by lifting assembly 52. The user couples component 18 to vehicle frame 16 with lifting assembly 52 in the assembly position 126. Upon coupling component 18 to vehicle frame 16, the user operates release assembly 122 to uncouple engagement assembly 108 from attachment member 84, and operates piston cylinder 98 to move piston 100 from retracted position 112 to extended position 110. The user then uncouples component support member 80 from component 18, and moves lifting assembly 52 towards supply area 20 to receive another component 18 that is adapted to be coupled to vehicle frame 16.

In one embodiment, component handling system 14 includes a computer control system 132 (shown in FIG. 4) that is operatively coupled to lifting assembly 52 and positioning assembly 54 to selectively position component handling system 14 in assembly position 126 and transfer position 124. In the exemplary embodiment, control system 132 includes a controller 134 that is coupled in communication with a plurality of sensors 136. Each sensor 136 detects various parameters relative to the orientation and position of component 18, positioning assembly 54, and lifting assembly 52. Sensors 136 may include, but are not limited to only including, position sensors, load sensors, and/or any other sensors that sense various parameters relative to the orientation and position of component 18 positioning assembly 54, and lifting assembly 52. As used herein, the term "parameters" refers to physical properties whose values can be used to define the orientation, position, and operating conditions of component 18, positioning assembly 54, and lifting assembly 52, such as positions, orientations, and weight loading at defined locations. Control system 132 includes at least one position sensor 138 that is coupled to positioning device 86 for sensing an orientation of positioning device 86 with respect to attachment member 84, and transmitting a signal indicative of the sensed position to controller 134. In addition, control system 132 includes at least one load sensor 140 that is coupled to lifting assembly 52 for sensing a weight load supported by lifting assembly 52, and transmitting a signal indicative of the sensed weight load to controller 134.

In the exemplary embodiment, controller 134 includes a processor 142 and a memory device 144. Processor 142 includes any suitable programmable circuit which may include one or more systems and microcontrollers, microprocessors, reduced instruction set circuits (RISC), application specific integrated circuits (ASIC), programmable logic circuits (PLC), field programmable gate arrays (FPGA), and any other circuit capable of executing the functions described herein. The above examples are exemplary only, and thus are not intended to limit in any way the definition and/or meaning of the term "processor." Memory device 144 includes a computer readable medium, such as, without limitation, random access memory (RAM), flash memory, a hard disk drive, a solid state drive, a diskette, a flash drive, a compact disc, a digital video disc, and/or any suitable device that enables processor 142 to store, retrieve, and/or execute instructions and/or data.

In the exemplary embodiment, controller 134 also includes a display 146 and a user interface 148. Display 146, in the exemplary embodiment, includes a vacuum fluorescent display (VFD) and/or one or more light-emitting diodes (LED). Additionally or alternatively, display 146 may include, without limitation, a liquid crystal display (LCD), a cathode ray tube (CRT), a plasma display, and/or any suitable visual output device capable of displaying graphical data and/or text to a user. In an exemplary embodiment, a component position, a component orientation, a force/strain measurement, a weight loading, and/or any other information may be displayed to a user on display 146. User interface 148 includes, without limitation, a keyboard, a keypad, a touch-sensitive screen, a scroll wheel, a pointing device, an audio input device employing speech-recognition software, and/or any suitable device that enables a user to input data into controller 134 and/or to retrieve data from controller 134. In one embodiment, user interface 148 is integrated with display 146 such that user interface 148 is accessed by a user via display 146. In the exemplary embodiment, the user may input control parameters into controller 134 using user interface 148 to control an operation of lifting assembly 52 and/or positioning assembly 54 to facilitate positioning component 18 with respect to vehicle frame 16.

Various connections are available between sensors 136, processor 142, memory device 144, display 146, and user interface 148. Such connections may include, without limitation, an electrical conductor, a low-level serial data connection, such as Recommended Standard (RS) 232 or RS-485, a high-level serial data connection, such as Universal Serial Bus (USB) or Institute of Electrical and Electronics Engineers (IEEE) 1394 (a/k/a FIREWIRE), a parallel data connection, such as IEEE 1284 or IEEE 488, a short-range wireless communication channel such as BLUETOOTH, and/or a private (e.g., inaccessible outside component handling system 14) network connection, whether wired or wireless.

In the exemplary embodiment, controller 134 is configured to operate component handling system 14 to position component 18 with respect to vehicle frame 16. During operation, controller 134 receives a signal from load sensor 140 that is indicative of a weight load supported from lifting assembly 52, and determines whether component 18 is coupled to lifting assembly 52 based at least in part on the sensed weight load. In addition, controller 134 receives a signal from position sensor 138 that is indicative of a position of engagement assembly 108 with respect to attachment member 84.

In the exemplary embodiment, controller 134 senses a position of engagement assembly 108 and operates positioning device 86 to move lifting assembly 52 from transfer position 124 to assembly position 126 upon sensing that engagement assembly 108 is adjacent to attachment member 84. Moreover, controller 134 operates engagement assembly 108 to couple positioning device 86 to attachment member 84 upon sensing engagement assembly 108 is adjacent attachment member 84. In one embodiment, controller 134 operates piston cylinder 98 to move piston 100 to the extended position 110 upon sensing a weight load that is indicative of component 18. In addition, with lifting assembly 52 in assembly position 126, controller 134 operates release assembly 122 to uncouple engagement assembly 108 from attachment member 84 upon sensing that component 18 is uncoupled from lifting assembly 52. In another embodiment, controller 134 energizes engagement assembly 108 including an electromagnetic assembly upon sensing that component 18 is coupled to lifting assembly 52, and de-energizes engagement assembly 108 upon sensing that component 18 is uncoupled from lifting assembly 52.

Figure 5:
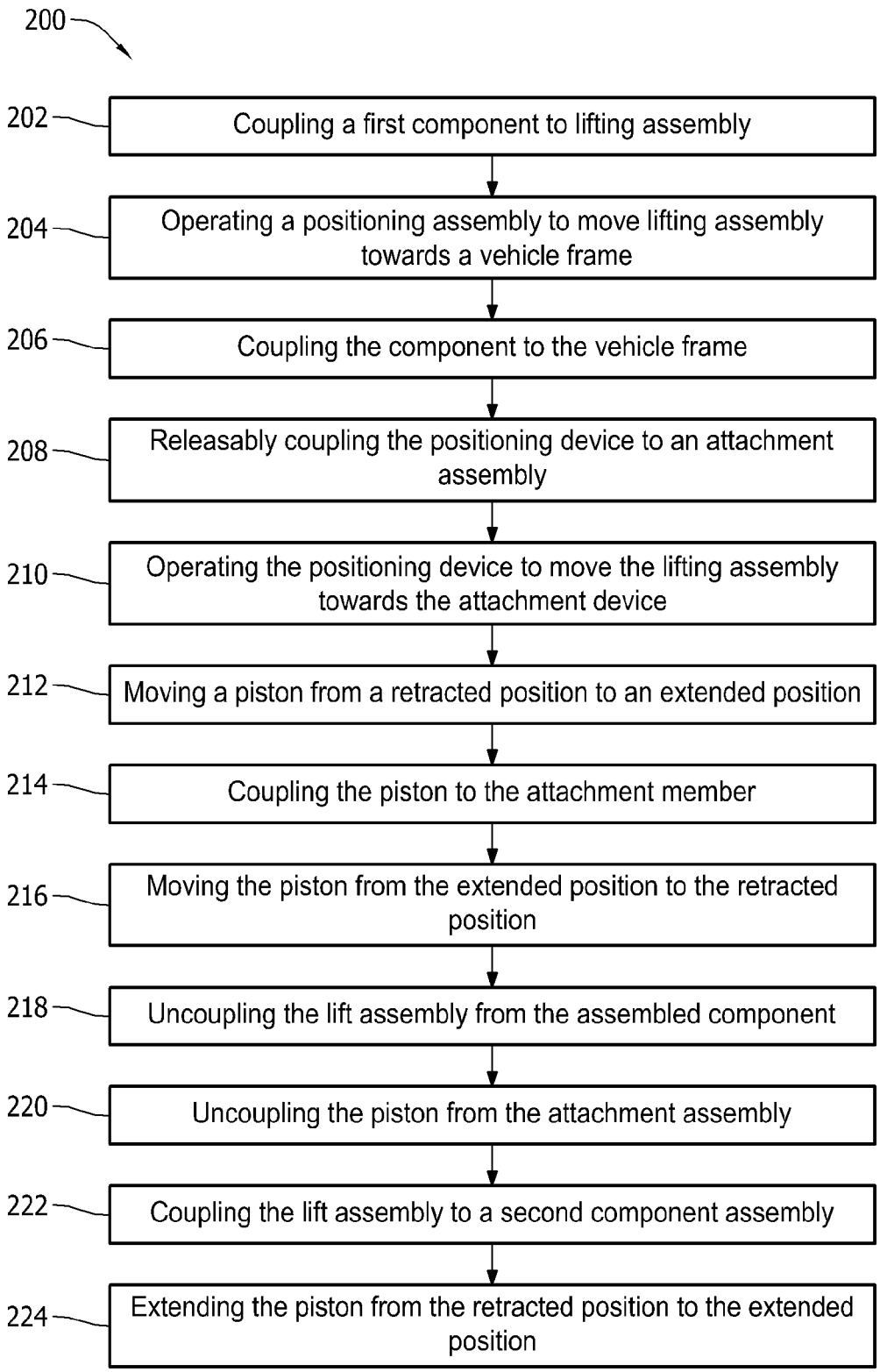
FIG. 5 is a flow chart of an exemplary method that may be used in assembling the vehicle shown in FIG. 1.

FIG. 5 is a flow chart of an exemplary method 200 that may be used in assembling vehicle 12. In the exemplary embodiment, method 200 includes releasably coupling 202 a first component 18 to lifting assembly 52, operating 204 positioning assembly 54 to move lifting assembly 52 towards vehicle frame 16 such that component 18 is biased against vehicle frame 16, and coupling 206 component 18 to vehicle frame 16. Method 200 also includes releasably coupling 208 positioning device 86 to attachment member 84, and operating positioning device 86 to move lifting assembly 52 towards attachment member 84. In addition, method 200 includes moving 210 piston 100 from a retracted position 112 to an extended position 110, coupling 212 piston 100 to attachment member 84, and moving 214 piston 100 from extended position 110 to retracted position 112 to position component 18 with respect to vehicle frame 16. Moreover, method 200 includes uncoupling 216 lifting assembly 52 from the assembled component 18, uncoupling 218 piston 100 from attachment member 84 when piston 100 is in the retracted position 112, coupling 220 lifting assembly 52 to a second component 18, and extending 222 piston 100 from the retracted position 112 to the extended position 110 to facilitate coupling piston 100 to attachment member 84.

The above-described systems and methods overcome at least some disadvantages of known vehicle manufacturing processes by providing a component handling system that enables one user to couple a component to a vehicle frame to form a vehicle. More specifically, the embodiments described herein include a component handling system that supports a component above a supporting surface and moves the component towards the vehicle frame to enable the user to couple the component to the vehicle frame. In addition, the component handling system described herein includes a lifting assembly that is configured to support the component, and a positioning assembly that is configured to move the lifting assembly to bias the component against the vehicle frame to enable the operator to couple the component to the vehicle frame. As such, the cost of assembling a vehicle is reduced over known assembling methods.

Exemplary embodiments of a component handling system for assembling vehicles and methods of assembling vehicles are described above in detail. The system and methods are not limited to the specific embodiments described herein, but rather, components of the system and/or steps of the method may be utilized independently and separately from other components and/or steps described herein. For example, the system may also be used in combination with other manufacturing systems and methods, and is not limited to practice with only the manufacturing systems and methods as described herein. Rather, an exemplary embodiment can be implemented and utilized in connection with many other vehicle assembly system applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A component handling system for use in assembling a vehicle, the vehicle including a vehicle frame and at least one component adapted to be coupled to the vehicle frame, said component handling system comprising:

a lifting assembly slideably coupled to a support frame, said lifting assembly configured to receive a component and to support the component from the support frame; and a positioning assembly coupled to the lifting assembly, said positioning assembly configured to move said lifting assembly along the support frame to bias the component towards the vehicle frame by actuating an actuatable member between an extended position and a retracted position, the actuatable member including a piston, wherein said positioning assembly comprises an attachment member coupled to the support frame, and a positioning device coupled to the lifting assembly, said positioning device comprising:

a piston assembly comprising a piston cylinder and the piston, said piston slideably coupled to the piston cylinder and movable between the extended position and the retracted position; and an engagement assembly coupled to said piston, said engagement assembly configured to releasably couple said piston to said attachment member, wherein said engagement assembly is configured to magnetically couple said piston to said attachment member when said piston is in the extended position, and to uncouple said piston from said attachment member when said piston is in the retracted position.

2. A component handling system in accordance with claim 1, wherein the support frame extends between a first end and a second end that is positioned closer to the vehicle assembly than the first end, said attachment member coupled to said second end such that said attachment member is positioned closer to a middle portion of the vehicle frame than the positioning device.

3. A component handling system in accordance with claim 1, wherein said piston is adapted to be coupled to said attachment member, said piston assembly moves said piston from the extended position to the retracted position when said piston is coupled to said attachment member.

4. A component handling system in accordance with claim 1, wherein said positioning device further comprises a position switch assembly coupled to said piston, said piston assembly configured to move said piston from the extended position to the retracted position when said position switch assembly contacts said attachment member.

5. A positioning assembly for use in assembling a vehicle, the vehicle including a vehicle frame and at least one component adapted to be coupled to the vehicle frame to form the vehicle, said positioning assembly comprising:

a positioning device coupled to a lifting assembly coupled to a support frame for supporting the component from the support frame, said positioning device comprising:

a piston assembly comprising a piston cylinder and a piston, and an engagement assembly coupled to said piston, said piston slideably coupled to said piston cylinder and movable between an extended position and a retracted position; and an attachment member coupled to the support frame, wherein said positioning device is configured to move the lifting assembly along the support frame towards the vehicle frame to position the component with respect to the vehicle frame by actuating the piston between the extended position and the retracted position, wherein said engagement assembly is configured to releasably couple said piston to said attachment member, to magnetically couple said piston to said attachment member when said piston is in the extended position, and to uncouple said piston from said attachment member when said piston is in the retracted position.

6. A positioning assembly in accordance with claim 5, wherein the support frame extends between a first end and a second end that is positioned closer to the vehicle frame than the first end, said attachment member coupled to said second end such that said attachment member is positioned closer to a middle portion of the vehicle frame than said positioning device.

7. A positioning assembly in accordance with claim 5, wherein said piston is adapted to be coupled to said attachment member, said piston assembly moves said piston from the extended position to the retracted position when said piston is coupled to said attachment member.

8. A positioning assembly in accordance with claim 5, wherein said positioning device further comprises a position switch assembly coupled to said piston, said piston assembly configured to move said piston from the extended position to the retracted position when said position switch assembly contacts said attachment member.

* * * * *